US007309962B2

(12) United States Patent
Chou et al.

(10) Patent No.: US 7,309,962 B2
(45) Date of Patent: Dec. 18, 2007

(54) PROTECTION CONTROL CIRCUIT FOR DISCHARGE LAMPS

(75) Inventors: Chin-Wen Chou, Taipei Hsien (TW); Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/188,625

(22) Filed: Jul. 26, 2005

(65) Prior Publication Data

US 2007/0024209 A1 Feb. 1, 2007

(51) Int. Cl.
*H05B 37/02* (2006.01)

(52) U.S. Cl. ..... 315/213; 315/295; 315/299

(58) Field of Classification Search ..... 315/210, 315/216, 226, 291, 294–301, 320, 324, 325, 315/213, 307, 362

See application file for complete search history.

(56) References Cited

U.S. PATENT DOCUMENTS 6,075,325 A * 6/2000 Kouno et al. ..... 315/307
6,107,754 A * 8/2000 Kim ..... 315/291
6,239,558 B1 * 5/2001 Fujimura et al. ..... 315/307
6,683,766 B1 * 1/2004 Guo et al. ..... 361/42
6,791,239 B2 9/2004 Chou et al.
6,867,955 B2 3/2005 Chou et al.
2001/0035698 A1 * 11/2001 Nakatsuka et al. ..... 310/318
2005/0122066 A1 6/2005 Chou et al.

FOREIGN PATENT DOCUMENTS

JP 2003229288 A * 8/2003

* cited by examiner

*Primary Examiner*—Thuy Vinh Tran
(74) *Attorney, Agent, or Firm*—Birch, Stewart, Kolasch & Birch, LLP

(57) ABSTRACT

A protection control circuit for discharge lamps aims to control protection signals input to a load at a rear end of a high voltage output zone that are generated during abnormal conditions. The high voltage output zone has a control unit and a driving unit, and a switch device interposed between them to receive a first voltage distribution signal output from the control unit and output a plurality of second voltage distribution signals corresponding to the number of the driving devices. Each of the driving devices is connected to a high voltage output zone line of the discharge lamp that feeds back a protection signal to the switch device. The switch device determines a first electricity condition or a second electricity condition of each high voltage output zone line of the discharge lamps that is connected to the individual driving device.

6 Claims, 2 Drawing Sheets

PROTECTION CONTROL CIRCUIT FOR DISCHARGE LAMPS

FIELD OF THE INVENTION

The present invention relates to a protection control circuit for discharge lamps and particularly to a protection control circuit adopted for used on a plurality of discharge lamp driving lines to provide independent protection control.

BACKGROUND OF THE INVENTION

Electricity control techniques for inverters are known in the art. U.S. Pat. No. 6,791,239 proposed by the Applicant is such an example. That technique focuses on the conventional inverter circuit and includes an individual pulse-width modulation (PWM) control unit, a driving unit, and a voltage boosting unit to drive an individual discharge lamp (CCFL or EEFL). As the size of display panels increases gradually, the number of the discharge lamps also increases. The required electricity increases too. Hence the size of circuit board to accommodate the configuration of the PWM control unit, driving unit and voltage boosting unit made according to the number of discharge lamps is larger, and circuit layout and production are more difficult. Illumination and electric field interference among the discharge lamps also increases. As a result, luminance uniformity suffers. While the aforesaid technique provides a solution, it mainly aims to provide, through a single PWM control unit, synchronous driving signals of the same phase and same frequency according to the driving units and voltage boosting units that are required to drive the discharge lamps on the rear end. Thereby each driving unit, voltage boosting unit and discharge lamp can be driven synchronously to achieve the uniform luminance.

U.S. Pat. No. 6,867,955 and U.S. Patent Publication No. 2005/0122066 A1 disclose other techniques to address the arc discharge phenomenon occurred to an inverter at a high voltage output zone in abnormal conditions. They provide a protection device which generates a protection signal which is fed back to a control unit to stop high voltage output in the high voltage zone.

However, with the size of the display panel increased constantly, the number of the discharge lamps increases even more. The driving lines for the driving units, voltage boosting units and discharge lamps also increase. If one of the lines is abnormal (not necessary malfunctions, could be an irregular voltage for a short period of time), the control unit receives the signal and stops all driving signals. If this situation occurs to the upper discharge lamps where heat concentrates, the display panel will be shut down and cannot display. Moreover, as the display panel becomes larger, if merely one discharge lamp is abnormal, it does not seriously effect user's viewing of the display panel. Hence the existing techniques that provide a single protection control mode are troublesome and undesirable.

SUMMARY OF THE INVENTION

Therefore the primary object of the present invention is to solve the aforesaid problems. The invention provides a protection control circuit that controls each driving line independently. In the event that one of the lines is abnormal, electricity output is suspended or temporarily halted only on that abnormal line. Hence the driving line of each discharge lamp can be protected and controlled independently.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
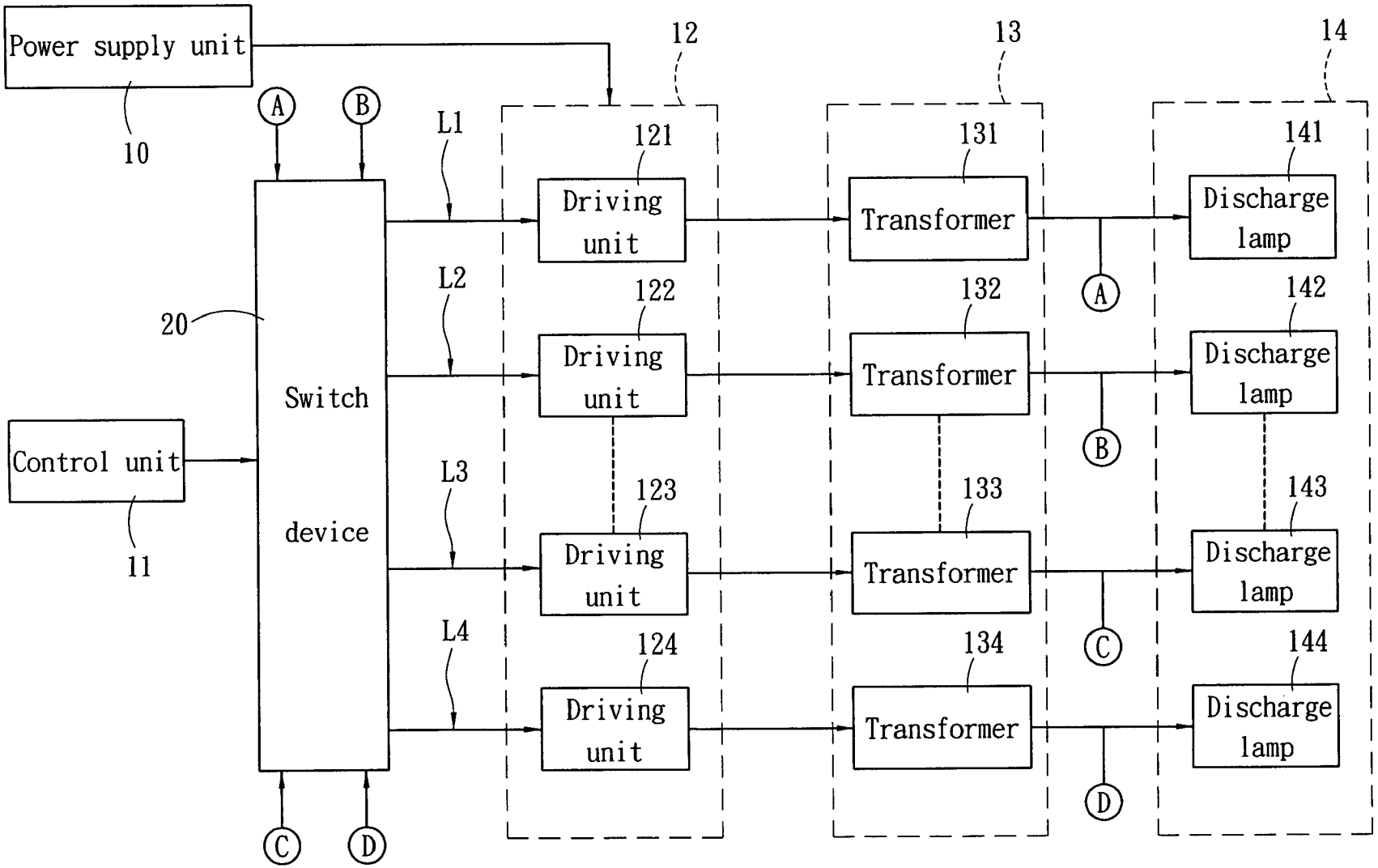
FIG. 1 is a circuit block diagram of an embodiment of the present invention.

Please refer to FIG. 1 for the circuit block diagram of an embodiment of the invention. The invention aims to control protection signals A, B, C and D input to a load 14 at a rear end of a high voltage output zone that are generated during abnormal conditions. The high voltage output zone includes a power supply unit 10 to provide power supply input, a control unit 11 to provide a first voltage distribution signal, a driving unit 12 to receive the power supply and the first voltage distribution signal and transform the voltage, a voltage boosting unit 13 to receive the transformed voltage and transform to a higher voltage, and the load 14 connecting to a high voltage output end of the voltage boosting unit 13. The invention targets the driving unit 12 which consists of a plurality of driving devices 121-124. The voltage boosting unit 13 and load 14 are connected to the driving devices 121-124, and include respectively a plurality of transformers 131-134 and discharge lamps 141-144. The invention further has a switch device 20 located in the high voltage output zone between the control unit 11 and the driving unit 12 to receive the first voltage distribution signal and output a plurality of second voltage distribution signals corresponding to the driving devices 121-124. Moreover, each of the driving devices 121-124 is connected to a high voltage output zone line L1-L4 of the discharge lamps 141-144, and feeds back individually a protection signal A, B, C, D to the switch device 20. The switch device 20 determines a first electricity condition or a second electricity condition for the individual high voltage output zone lines L1-L4 of the discharge lamps 141-144 that are connected to the driving devices 121-124.

The first electricity condition is an electric conductive condition and the second electricity condition is an electric interrupt or idle condition. The switch device 20 may be an analog switch, relay, micro-controller or an electronic element capable of distributing multiple signals. As shown in the drawing, the control unit 11 converts the first voltage distribution signal through the switch device 20 to a plurality of second voltage distribution signals to the driving lines L1-L4. It is to be noted that, depending on different electric characteristics of electronic elements, the multiple second voltage distribution signals may have same phase and same frequency as taught in U.S. Pat. No. 6,791,239. Thereby uniform luminance can be achieved on the discharge lamps 141-144. For the switch device 20 made of a micro-controller, in the event that an abnormal condition occurred to each of the driving lines L1-L4 (such as the voltage alters due to increasing of line resistance), the second voltage distribution signals of the abnormal driving lines L1-L4 can be regulated according to the feedback protection signals A, B, C and D to enhance the uniform luminance of the discharge lamps 141-144. The invention mainly aims to feed back the protection signals A, B, C and D of the driving lines L1-L4 to the switch device 20. The feedback approach can adopt, but not limited to, the direct feedback as shown in the drawing, or the ones adopted in U.S. Pat. No. 6,867,955 and U.S. Patent Publication No. 2005/0122066A1. Whatever the feedback approach, in the event that one of the driving lines L1-L4 is abnormal (say L1), the protection signal A fed back on the abnormal circuit L1 is detected by the switch device 20, and the abnormal circuit L1 is switched to the second electricity condition. The rest driving lines L2-L4 are not affected and can function continuously.

Figure 2:
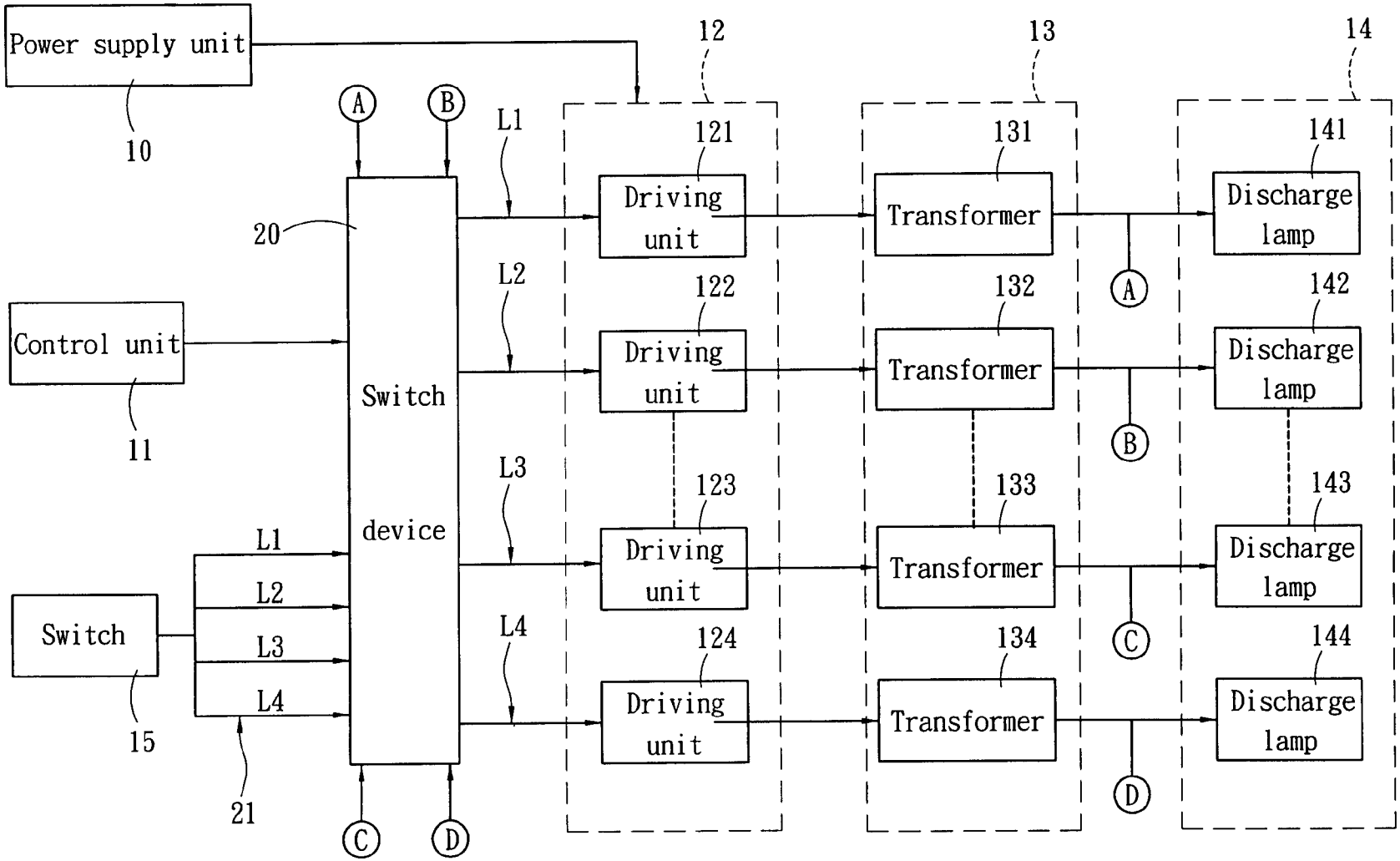
FIG. 2 is a circuit block diagram of another embodiment of the present invention.

Refer to FIG. 2 for another embodiment of the invention. The switch device 20 may also be electrically connected to a switch 15 which inputs a plurality of switch signals 21 corresponding to the number of driving lines L1-L4 for the driving devices 121-124 to the switch device 20. The switch 15 may be located on a video circuit board which controls the luminance of the display panel, or be directly installed on the exterior of the display panel. For instance, if user sees pictures that do not fully occupy the entire display panel (such as a movie in a 16:9 displaying format), the upper end and lower end of the display panel are black. Then the switch 15 can output the switch signal 21 to close or idle the driving lines L1-L4 of the discharge lamps 141-144 in that area to save electric energy.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A protection control circuit for discharge lamps to control protection signals input to a load at a rear end of a high voltage output zone that are generated during abnormal conditions, the high voltage output zone comprising a power supply unit to provide power supply input, a control unit to provide a first voltage distribution signal, a driving unit to receive the power supply and the first voltage distribution signal and transform voltage, a voltage boosting unit to receive the transformed voltage and transform to a high voltage, and the load connecting to a high voltage output end of the voltage boosting unit, wherein:

the driving unit includes a plurality of driving devices, the voltage boosting unit and the load being connected to the driving devices and including respectively a plurality of transformers and discharge lamps, the high voltage output zone between the control unit and the driving unit being bridged by a switch device to receive the first voltage distribution signal and output a plurality of second voltage distribution signals corresponding to the driving devices, each of the driving devices being connected to a high voltage output zone line of the discharge lamps that feeds back individually a protection signal to the switch device, the switch device determining one of a first electricity condition and a second electricity condition of each high voltage output zone line of the discharge lamps that is connected to the individual driving device; and wherein the switch device is electrically connected to a switch which inputs a plurality of switch signals to the switch device corresponding to the number of the driving devices.

2. The protection control circuit for discharge lamps of claim 1, wherein the first electricity condition in an electric conductive condition and the second electricity condition is an electric interrupt condition.

3. The protection control circuit for discharge lamps of claim 1, wherein the first electricity condition in an electric conductive condition and the second electricity condition is an electric idle condition.

4. The protection control circuit for discharge lamps of claim 1, wherein the switch device is an analog switch.

5. The protection control circuit for discharge lamps of claim 1, wherein the switch device is a relay.

6. The protection control circuit for discharge lamps of claim 1, wherein the switch device is a micro-controller.

* * * * *